US011805849B2

(12) United States Patent
Lewison et al.

(10) Patent No.: US 11,805,849 B2
(45) Date of Patent: Nov. 7, 2023

(54) SINGLE-PULL TIGHTENED SNOWSHOE BINDING

(71) Applicant: Kwik Tek, Inc., Denver, CO (US)

(72) Inventors: Corey A. Lewison, Superior, CO (US); Kevin J. Kresch, Arvada, CO (US)

(73) Assignee: Kwik Tek, Inc., Denver, CO (US)

( * ) Notice: Subject to any disclaimer, the term of this patent is extended or adjusted under 35 U.S.C. 154(b) by 149 days.

(21) Appl. No.: 17/446,345

(22) Filed: Aug. 30, 2021

(65) Prior Publication Data

US 2022/0071339 A1 Mar. 10, 2022

Related U.S. Application Data

(60) Provisional application No. 63/113,357, filed on Nov. 13, 2020, provisional application No. 63/076,069, filed on Sep. 9, 2020.

(51) Int. Cl.

| | |
|---|---|
| ***A43B 5/04*** | (2006.01) |
| ***A43B 13/02*** | (2022.01) |
| ***A63C 13/00*** | (2006.01) |

(52) U.S. Cl.

CPC ..... *A43B 5/0417* (2013.01); *A43B 5/0421* (2013.01); *A43B 13/02* (2013.01);

(Continued)

(58) Field of Classification Search

CPC ..... A43B 5/0417; A43B 13/02; A43B 5/0421; A63C 13/006; A63C 13/003; A63C 13/001

See application file for complete search history.

(56) References Cited

U.S. PATENT DOCUMENTS 2,511,087 A 6/1950 Villemur
2,619,742 A * 12/1952 Cumming ..... A63C 13/001 36/125

(Continued)

FOREIGN PATENT DOCUMENTS

WO WO03056962 A1 7/2003
WO WO2012109463 8/2012
WO WO2019116144 A1 6/2019

OTHER PUBLICATIONS

MSR Evo 22" Snowshoe.

(Continued)

*Primary Examiner* — Sharon M Prange
*Assistant Examiner* — Erick I Lopez
(74) *Attorney, Agent, or Firm* — Talus Law Group LLC

(57) ABSTRACT

A single-pull tightened snowshoe binding is provided, the binding comprising: a sole plate configured to be hingedly interconnected to a snowshoe; a toe cap interconnected with the sole plate with a first anterior strap and a second anterior strap, wherein the anterior straps are configured to wrap around the lateral aspects of a toe box of a shoe inserted within the snowshoe binding, and wherein the toe cap is configured to interface with a top aspect of the shoe; a first lateral strap extending outward from the sole plate, wherein the first lateral strap is configured to wrap upward along a lateral aspect of the shoe and extend toward a posterior aspect of the shoe; a second lateral strap extending outward from the sole plate, wherein the second lateral strap is configured to wrap upward along a lateral aspect of a shoe and extend toward the posterior aspect of the snowshoe binding; a first tightening strap having a first end and a second end, the first end of the first tightening strap interconnected to a posterior aspect of the toe cap, the first tightening strap slideably interconnected with the distal end of the first lateral strap, wherein the second end of the first (Continued)

tightening strap is configured to span around the posterior aspect of the shoe; a second tightening strap having a first end and a second end, the first end of the second tightening strap interconnected to a posterior aspect of the toe cap, the second tightening strap slideably interconnected with the distal end of the second lateral strap, wherein the second end of the second tightening strap is configured to span around the posterior aspect of the shoe; the second ends of the first and second tightening straps interconnected by a strap tightening mechanism; wherein tightening of the first and second tightening straps simultaneously retracts the toe cap toward the sole plate, retracts the first and second lateral straps upward along a lateral aspect of a shoe inserted in the binding, and biases the shoe toward the toe cap.

18 Claims, 5 Drawing Sheets

(52) U.S. Cl.
CPC ..... *A63C 13/001* (2013.01); *A63C 13/003* (2013.01); *A63C 13/006* (2013.01)

(56) References Cited

U.S. PATENT DOCUMENTS

| | | | | |
|---|---|---|---|---|
| 2,699,613 | A | 1/1955 | Peterson | |
| 3,755,926 | A * | 9/1973 | Schonbrun | A63C 13/001 36/125 |
| 5,459,950 | A | 10/1995 | Damm | |
| 5,517,772 | A | 5/1996 | Anderson | |
| 5,740,621 | A | 4/1998 | Wing | |
| 5,836,093 | A * | 11/1998 | Gallay | A63C 13/006 36/125 |
| 5,970,632 | A | 10/1999 | Watson | |
| 6,742,286 | B2 * | 6/2004 | Giovale | A43C 15/061 36/97 |
| 7,509,757 | B2 | 3/2009 | Monsees | |
| 2002/0104235 | A1 | 8/2002 | Mahon | |
| 2003/0052473 | A1 | 3/2003 | Perkins | |
| 2003/0167657 | A1 | 9/2003 | Kiniry | |
| 2004/0231200 | A1 | 11/2004 | Forrest | |
| 2005/0050773 | A1 | 3/2005 | Kettlehut | |
| 2005/0183291 | A1 | 8/2005 | Kiniry | |
| 2007/0079529 | A1 * | 4/2007 | Ekberg | A63C 13/005 36/122 |
| 2007/0163151 | A1 | 7/2007 | Monsees | |
| 2007/0163152 | A1 | 7/2007 | Emerson | |
| 2007/0163154 | A1 | 7/2007 | Emerson | |
| 2007/0163155 | A1 | 7/2007 | Emerson | |
| 2016/0144266 | A1 | 5/2016 | Dussault | |
| 2017/0225061 | A1 | 8/2017 | Locatelli | |
| 2018/0369682 | A1 * | 12/2018 | Faber | A63C 13/006 |

OTHER PUBLICATIONS

Yukon Charlie's Elite SPIN Snowshoe.
Atlas Montane Snowshoe.
Atlas Race Snowshoe.
Atlas Range—BC Snowshoe.
Atlas Range—MTN Snowshoe.
Atlas Range—Trail Snowshoe.
Atlas Run Snowshoe.
Yukon Charlie's Running Snowshoe.
Yukon Charlie's Sherpa Series Snowshoe.
Atlas Apex—BC Snowshoe.
MSR Lightning Acent Snowshoe.
MSR REVO Explore Snowshoe.
L.L. Bean Winter Walker Snowshoe.

* cited by examiner

SINGLE-PULL TIGHTENED SNOWSHOE BINDING

CROSS REFERENCE TO RELATED APPLICATIONS

This application claims the benefit of U.S. Provisional Patent Application 63/076,069, filed on Sep. 9, 2020 and entitled SINGLE PULL TIGHTENED SNOWSHOE BINDING, and U.S. Provisional Patent Application 63/113,357, filed on Nov. 13, 2020 and entitled SINGLE-PULL TIGHTENED SNOWSHOE BINDING, the entire contents of both of which are incorporated herein by reference in their entirety for all purposes.

FIELD OF THE INVENTION

The present invention is directed to single-pull tightened snowshoe binding for releasably interconnecting to a shoe through a single action rather than requiring multiple steps to transition between a first configuration allowing the insertion of a shoe into the binding and second configuration constraining the shoe within the binding.

SUMMARY OF INVENTION

A single-pull tightened snowshoe binding is provided, the binding comprising: a sole plate configured to be hingedly interconnected to a snowshoe along an axis extending transversely with respect to the longitudinal axis of the snowshoe; a toe cap interconnected with the sole plate with a first anterior strap and a second anterior strap, wherein the anterior straps are configured to wrap around the lateral aspects of a toe box of a shoe inserted within the snowshoe binding, and wherein the toe cap is configured to interface with a top aspect of the shoe; a first lateral strap extending outward from the sole plate, wherein the first lateral strap is configured to wrap upward along a lateral aspect of the shoe and extend toward a posterior aspect of the shoe; a second lateral strap extending outward from the sole plate, wherein the second lateral strap is configured to wrap upward along a lateral aspect of a shoe and extend toward the posterior aspect of the snowshoe binding; a first tightening strap having a first end and a second end, the first end of the first tightening strap interconnected to a posterior aspect of the toe cap, the first tightening strap slideably interconnected with the distal end of the first lateral strap, wherein the second end of the first tightening strap is configured to span around the posterior aspect of the shoe; a second tightening strap having a first end and a second end, the first end of the second tightening strap interconnected to a posterior aspect of the toe cap, the second tightening strap slideably interconnected with the distal end of the second lateral strap, wherein the second end of the second tightening strap is configured to span around the posterior aspect of the shoe; the second ends of the first and second tightening straps interconnected by a strap tightening mechanism; wherein tightening of the first and second tightening straps simultaneously retracts the toe cap toward the sole plate, retracts the first and second lateral straps upward along a lateral aspect of a shoe inserted in the binding, and biases the shoe toward the toe cap. The present invention provides a number of advantages depending on the particular aspect, embodiment, and/or configuration.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible utilizing, alone or in combination, one or more of the features set forth above or described in detail below. Also, while the disclosure is presented in terms of exemplary embodiments, it should be appreciated that individual aspects of the disclosure can be separately claimed.

DETAILED DESCRIPTION OF VARIOUS EMBODIMENTS

Figure 1:
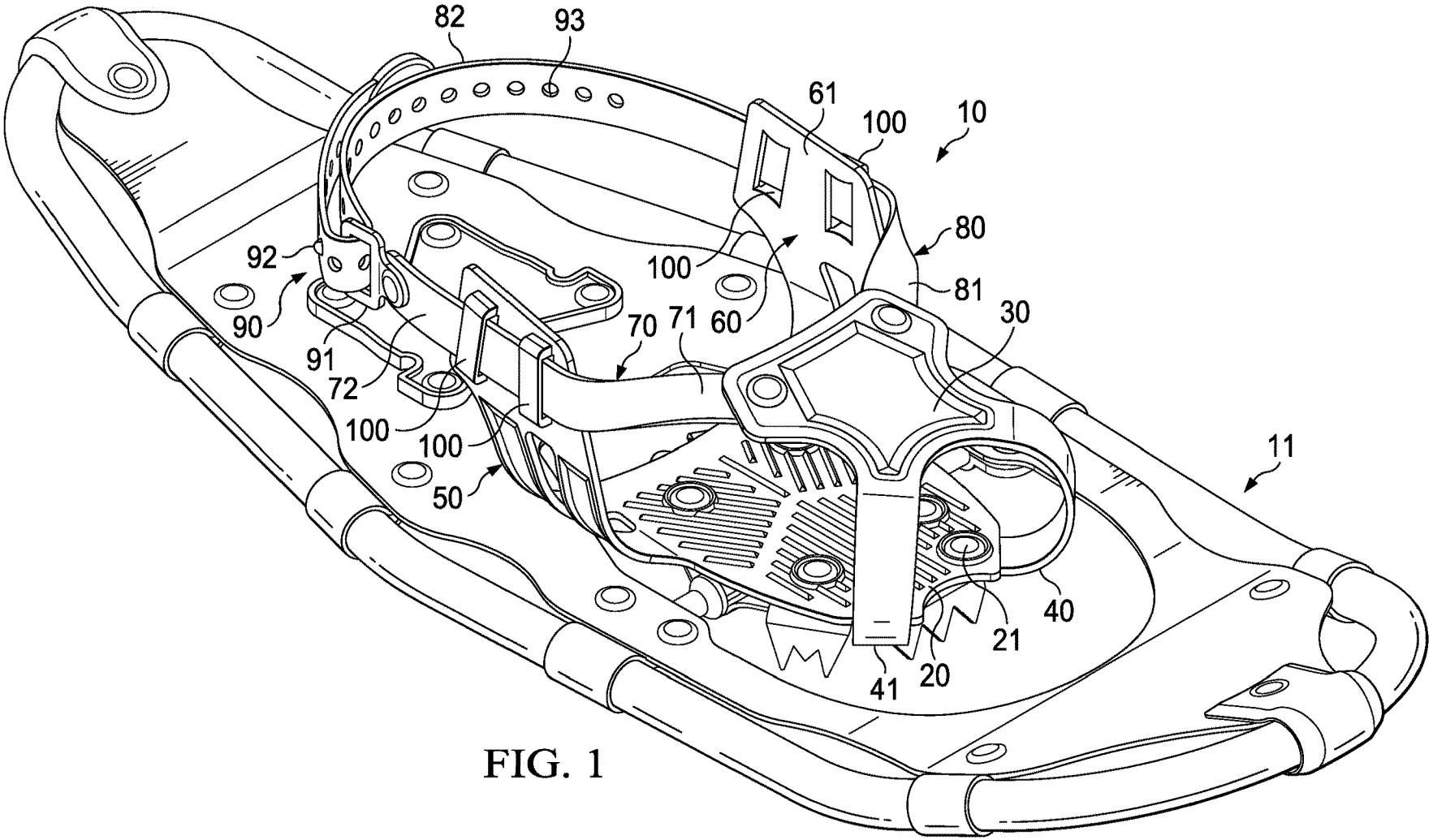
FIG. 1 is a top perspective view of a single-pull tightened snowshoe binding according to one embodiment of the present disclosure.

Referring to an exemplary embodiment of the present invention, shown in FIGS. 1-5, is a snowshoe binding 10 generally comprising a sole plate 20, a toe cap 30, first anterior strap 40 and second anterior strap 41, a first lateral strap 50, a second lateral strap 60, a first tightening strap 70, a second tightening strap 80, and a strap tightening mechanism 90.

Figure 2:
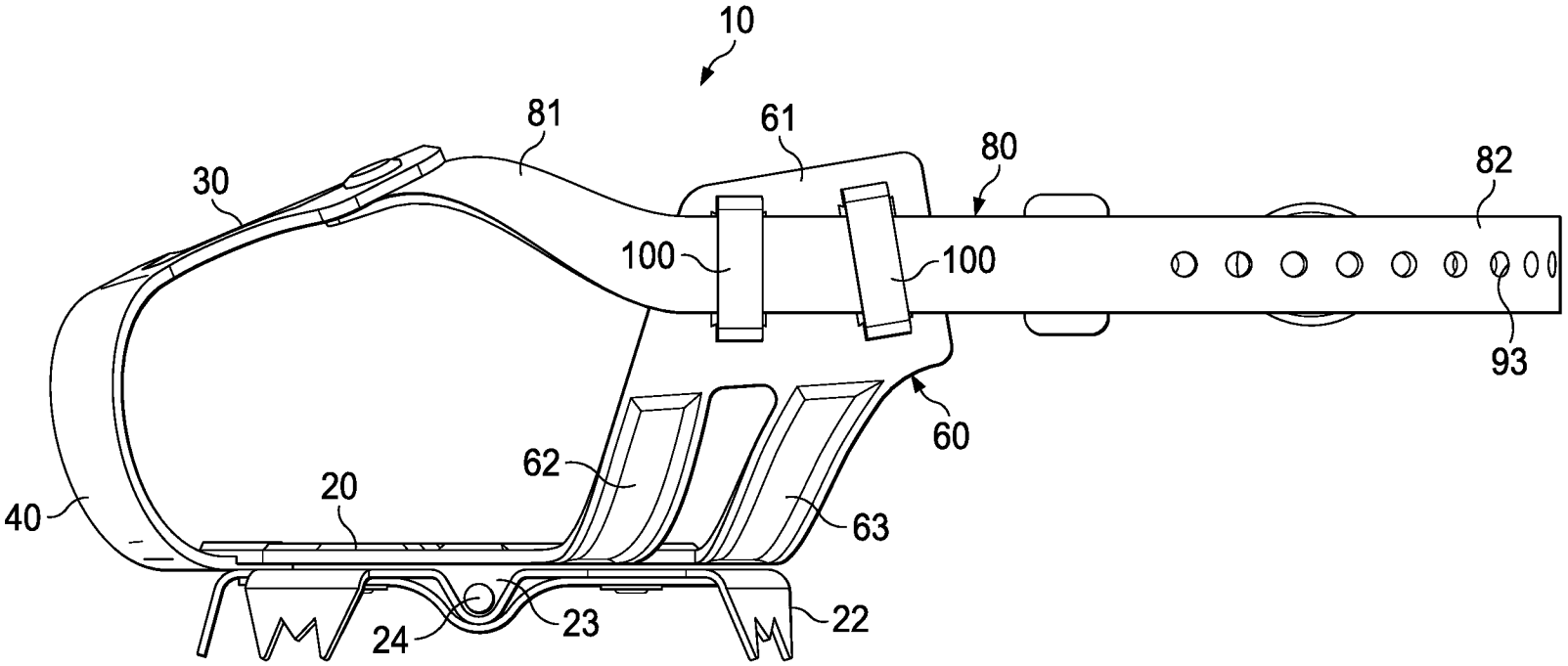
FIG. 2 is a left elevation view of a single-pull tightened snowshoe binding in a first configuration according to one embodiment of the present disclosure.
Figure 3:
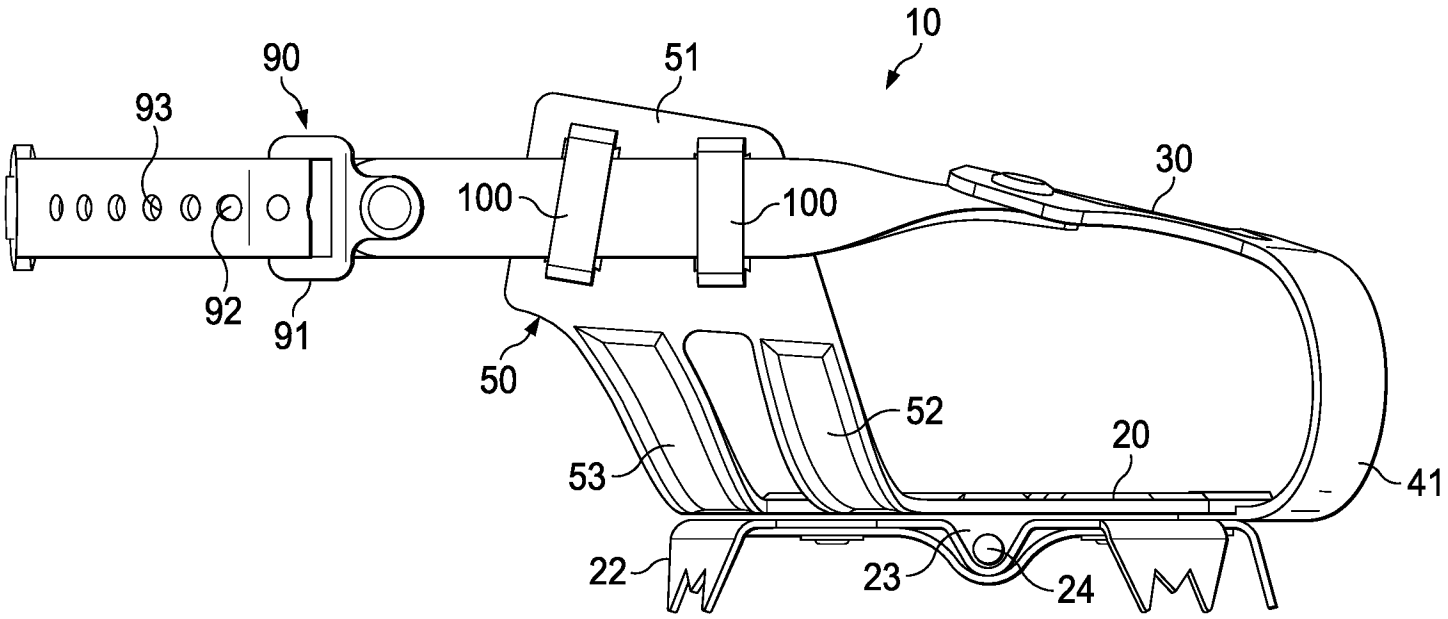
FIG. 3 is a right elevation view of a single-pull tightened snowshoe binding in a second configuration according to one embodiment of the present disclosure.
Figure 5:
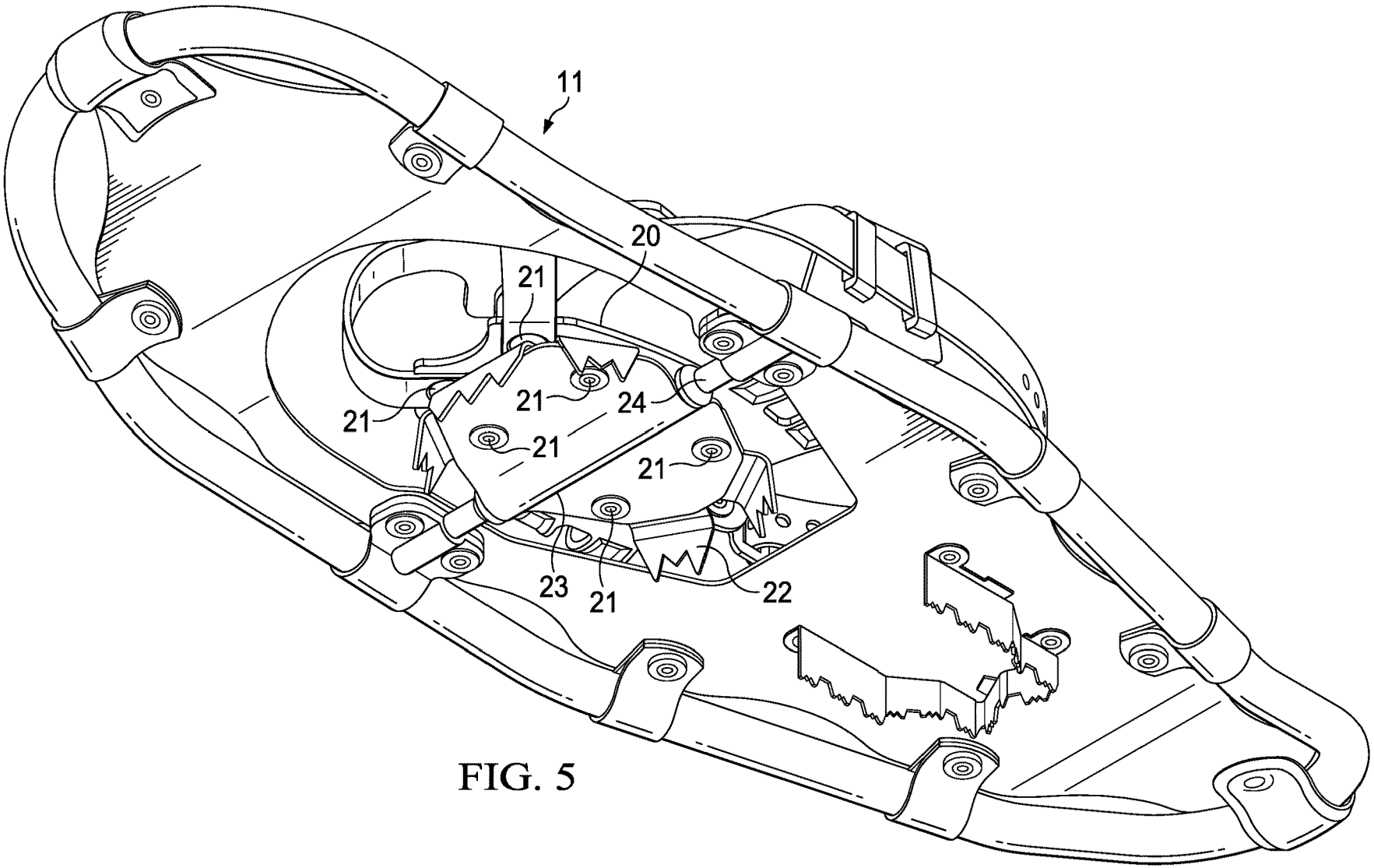
FIG. 5 is a bottom perspective view of a single-pull tightened snowshoe binding according to one embodiment of the present disclosure.

As shown in FIGS. 2-3 and 5, the sole plate 20 is hingedly interconnected to a snowshoe 11 along an axis extending transversely to the longitudinal axis of the snowshoe 11. In a preferred embodiment, the sole plate 20 is interconnected by rivets 21 or bolts to a crampon plate 22 comprising an axial channel 23. An axle 24 affixed to the snowshoe 11 is rotatably contained within the axial channel 23 between the sole plate 20 and the crampon plate 22 so that the sole plate 20 may hinge about the axle 24. In a preferred embodiment, the sole plate 20 is made of molded polyurethane and the crampon plate 22 is made of steel or aluminum.

As shown in FIG. 1, in a preferred embodiment, first anterior strap 40 and second anterior strap 41 are interconnected to the toe cap 30 and configured to wrap around the front lateral aspects of the toe box of a shoe. In one embodiment, the straps 40 and 41 are interconnected to the sole plate 20 by rivets 21. However, the anterior straps 40 and 41 could be integrally formed with the sole plate 20. Likewise, in the embodiment shown, the anterior straps 40 and 41 are integrally formed with the toe cap 30. However, the anterior straps 40 and 41 could be interconnected to the toe cap 30 by other methods such as by riveting. In another embodiment, the toe cap 30 is interconnected to the sole plate by a single anterior strap or by more than two anterior straps. Alternatively, the toe cap 30 is shaped to receive the toe portion of a shoe and is interconnected to the sole plate 20 or formed with the sole plate 20 from a single piece of flexible material. The toe cap 30 is configured to receive the toe portion of a shoe wherein the sole plate 20 supports the bottom aspect of the shoe, the toe cap 30 rests on the top aspect of the shoe, and the anterior straps 40 and 41 interface with the front lateral aspects of the toe portion of the shoe. Alternatively, the toe cap 30 is shaped to receive the toe portion of the shoe and interfaces with the top and front aspects of the shoe. In a preferred embodiment, the toe cap 30 and anterior straps 40 and 41 are made of molded polyurethane. In some embodiments, the toe cap 30 may further comprise a pad on the bottom surface made of EVA foam in a preferred mode.

As shown in FIG. 1-3, in a preferred embodiment, first tightening strap 70 has a first end 71 and a second end 72. The first end 71 of first tightening strap 70 is interconnected at a posterior aspect of the toe cap 30 and the second end 72 is configured to span around the posterior aspect of a shoe inserted in the binding. An intermediate portion of the first tightening strap 70 is slideably interconnected to a distal end 51 of first lateral strap 50 by sleeves 100. Second tightening strap 80 has a first end 81 and a second end 82. The first end 81 of second tightening strap 80 is interconnected at a posterior aspect of the toe cap 30 and the second end 82 is configured to span around the posterior aspect of a shoe inserted in the binding. An intermediate portion of the second tightening strap 80 is slideably interconnected to a distal end 61 of second lateral strap 60 by sleeves 100. The second ends 72 and 82 of the first and second tightening straps 70 and 80 are interconnected by a strap tightening mechanism 90. In a preferred embodiment, the first and second tightening straps 70 and 80 are comprised of molded polyurethane. In another embodiment, the first and second tightening straps 70 and 80 are comprised of nylon webbing or nylon webbing with a plastic coating. In another embodiment, the first and second tightening straps 70 and 80 are comprised of a cord or rope and are interconnected by a cord locking mechanism.

Figure 4:
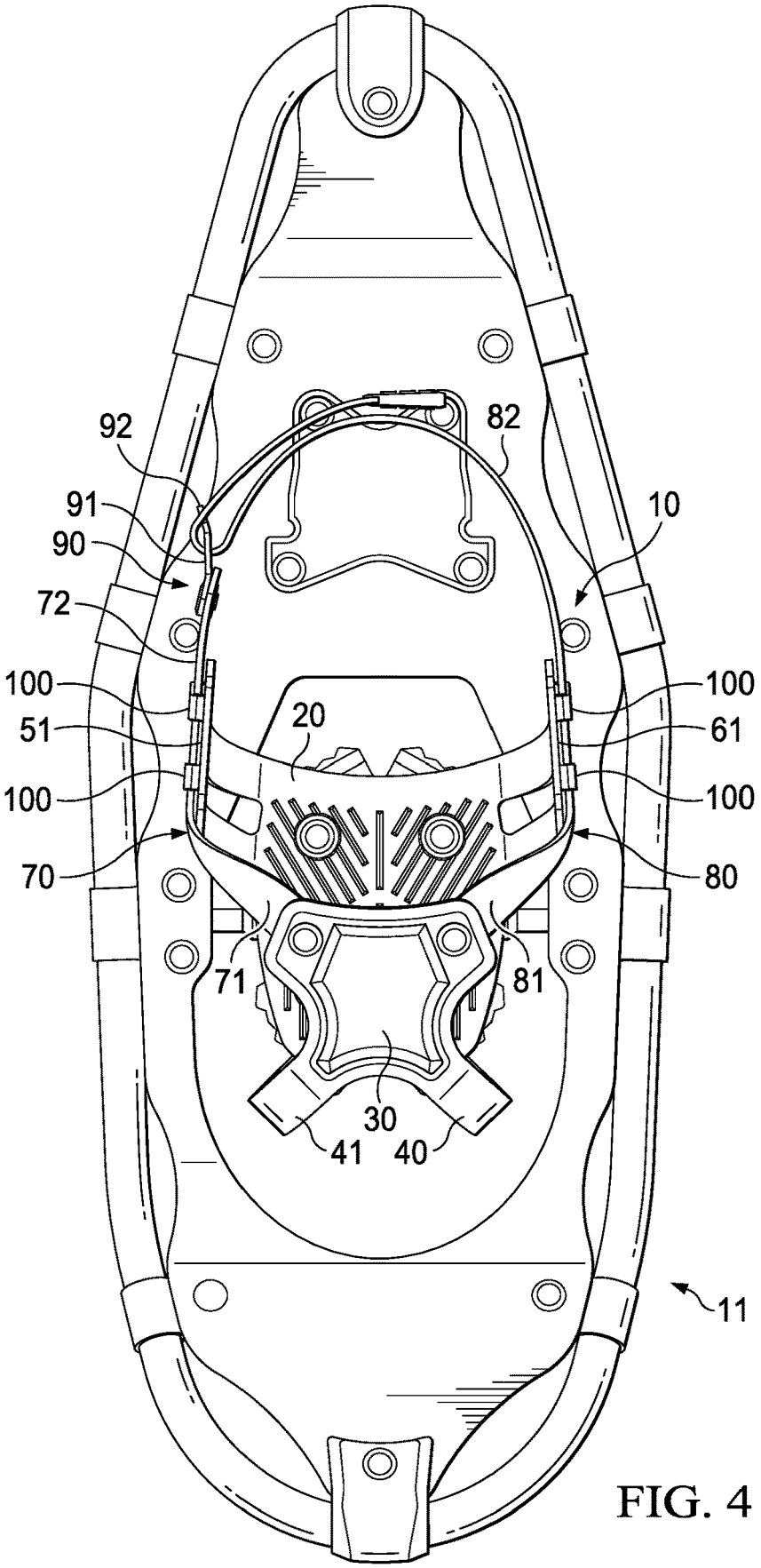
FIG. 4 is a top view of a single-pull tightened snowshoe binding according to one embodiment of the present disclosure.

As shown in FIGS. 1, 3 and 4, in one embodiment, the strap tightening mechanism 90 comprises a buckle comprising a frame 91 and prong 92 interconnected to the second end 72 of the first tightening strap 70 which allows a user to tighten or loosen the binding using the adjustment holes 93 in the second end 82 of the second tightening strap 80. Alternatively, the tightening mechanism may comprise: a ratchet buckle such as that disclosed in U.S. Pat. No. 8,763,209; a rack and pinion mechanism such as that disclosed in U.S. Pat. No. 8,015,625; or an adjustable side-release buckle, strap lock buckle, or cam buckle such as the molded plastic devices available from National Webbing Products.

As shown in FIG. 2, beginning in the first configuration, the toe cap 30 is extended away from the sole plate 20 allowing the insertion of the toe portion of a shoe between the sole plate 20 and the toe cap 30, and in contact with the anterior straps 40 and 41. The heal portion of the shoe is inserted forward of the first and second tightening straps 70 and 80. Utilizing tightening mechanism 90, the first and second tightening straps 70 and 80 are shortened which tensions the tightening straps relative to toe cap 30 and causes the lateral sides of the posterior aspect of the toe cap 30 to retract simultaneously and about equally in a downward direction toward the sole plate 20 as shown in FIG. 3.

Simultaneously, the tension in the first and second tightening straps 70 and 80 causes the first and second lateral straps 50 and 60 to retract upward along a lateral aspect of a shoe inserted in the binding. Tightening the first and second tightening straps 70 and 80 also biases the shoe toward the toe cap 30. As shown in FIG. 3, in this second configuration, when the toe cap 30 is retracted toward the sole plate 20, the shoe is captured between the sole plate 20 and the toe cap 30.

Beginning in the second configuration, releasing or loosening tightening mechanism 90 allows the first and second tightening straps 70 and 80 to lengthen, allowing the first and second lateral straps 50 and 60 to extend away from the lateral aspect of the shoe and the toe cap 30 to extend away from the sole plate 20 and the placing the snowshoe binding in the first configuration.

As shown in FIGS. 1-4, in a preferred embodiment comprising flexible lateral straps 50 and 60, the lateral straps are interconnected with the sole plate 20. The first lateral strap 50 extends outward from the sole plate and is configured to wrap upward along a lateral aspect of the shoe, then extend toward a posterior aspect of a shoe. The second lateral strap 60 extends outward from the sole plate and is configured to wrap upward along a lateral aspect of the shoe, then extend toward a posterior aspect of a shoe. The distal ends of the first and second lateral straps, 51 and 61 respectively, comprise slidable sleeves 100. In a preferred embodiment, the lateral straps 50 and 60 are comprised of a first vertical portion 52 and 62 and a second vertical portion 53 and 63. The separated first and second portions allow the lateral straps to better conform to the lateral aspect of the shoe. In a preferred embodiment, the lateral straps 50 and 60 are comprised of a flexible but resilient material, such as molded polyurethane, which allow the lateral straps 50 and 60 to conform around a shoe when the snowshoe binding 10 is tightened, but that tend to spring back towards an open position when the snowshoe binding 10 is loosened.

As shown in FIGS. 2-4, the distal ends 51 and 61 of the first and second lateral straps 50 and 60 are slideably interconnected to an intermediate portion of the first and second tightening straps 70 and 80, respectively, by sleeves 100. The sleeves 100 are oriented to maintain a longitudinal direction of the first and second tightening straps 70 and 80 relative to the extended direction of the posterior portions of lateral straps 50 and 60. In an alternative embodiment, the first and second tightening straps 70 and 80 are slidably interconnected to the distal ends 51 and 61 of the first and second lateral straps 50 and 60 using a single elongated sleeve, channel, or passageway. First and second tightening straps 70 and 80 are configured to span around the posterior aspect of the shoe between the distal ends 51 and 61 of the lateral straps.

As shown in FIG. 2, in a first configuration, the toe cap 30 is extended away from the sole plate 20 and the first and second tightening straps 70 and 80 are extended in a posterior direction of the snowshoe binding. The first configuration allows the insertion of the toe box of a shoe between the sole plate 20, the toe cap 30, and in contact with the anterior straps 40 and 41, and the heel of the shoe between the lateral straps 50 and 60 and forward of the first and second tightening straps 70 and 80. As shown in FIG. 3, in a second configuration, shortening of the first and second tightening straps 70 and 80 using tightening mechanism 90 causes the toe cap 30 to retract toward the sole plate 20 thereby interconnecting the shoe between the sole plate 20 and the toe cap 30, tensioning of the lateral straps 50 and 60 around the lateral aspects of the shoe, and tensioning of the first and second tightening straps 70 and 80 around the posterior aspect of the shoe, thereby urging the shoe in a forward direction towards the toe cap 30 and first and second anterior straps 40 and 41.

As used herein, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together. The term "a" or "an" entity refers to one or more of that entity. As such, the terms "a" (or "an"), "one or more" and "at least one" can be used interchangeably herein. It is also to be noted that the terms "comprising," "including," and "having" are used interchangeably and are meant to encompass the items listed thereafter and equivalents thereof, as well as additional items. As used herein, the term "lateral" means of, at, toward, or from the side or sides. The term "medial" is often used to medically refer to the inside of the foot and "lateral" is used to medically refer to the outside of the foot, but herein, "lateral" can refer to either the inside or outside of a foot or shoe.

The structural materials employed advantageously in the present invention are fashioned from: molded, injected, extruded, or machined plastics; molded, injected, extruded, or machined rubber; extruded, machined, or cast aluminum, stainless steel, or other metals; and suitable alternatives are available, as one skilled in the art would recognize readily. Likewise, any padding, where padding is desirable, is preferably some kind of foamed elastomer, though other suitable materials exist. Other hardware, brackets, locking pins and supports may be fashioned from aluminum, stainless steel, brass, or other suitable material. One of ordinary skill in the art will appreciate that embodiments of the present disclosure may be constructed of materials known to provide, or predictably manufactured to provide the various aspects of the present disclosure. These materials may include, for example, stainless steel, titanium alloy, aluminum alloy, chromium alloy, and other metals or metal alloys. These materials may also include, for example, carbon fiber, ABS plastic, polyurethane, and other fiber-encased resinous materials, synthetic materials, polymers, and natural materials. The system and its elements could be flexible, semi-rigid, or rigid and made of materials such as stainless steel, titanium alloy, aluminum alloy, chromium alloy, and other metals or metal alloys, carbon fiber, ABS plastic, polyurethane, and other fiber-encased resinous materials, synthetic materials, polymers, and natural materials. In one embodiment, some or all components are manufactured by way of 3-D printing.

The present disclosure, in various aspects, embodiments, and/or configurations, includes components, methods, processes, systems and/or apparatus substantially as depicted and described herein, including various aspects, embodiments, configurations embodiments, sub-combinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing description has been presented for purposes of illustration and description. The foregoing is not intended to limit the disclosure to the form or forms disclosed herein. In the foregoing description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. References to a shoe in the claims herein is intended to express the functionality of the binding relative to a shoe that may be inserted within the binding and is not intended to require that a shoe be within the binding in the claimed invention.

While various embodiments of the present invention are described herein in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges, or steps to those claimed, whether or not such alternate, interchangeable and/or equivalent structures, functions, ranges or steps are disclosed herein, and without intending to publicly dedicate any patentable subject matter.

What is claimed is:

1. A snowshoe binding comprising:

a sole plate configured to be hingedly interconnected to a snowshoe along an axis extending transversely to a longitudinal axis of the snowshoe;

a toe cap interconnected to the sole plate, wherein the toe cap is configured to interface with a top aspect of a shoe inserted within the snowshoe binding;

a first lateral strap extending from the sole plate comprising a lower portion configured to wrap upward along a lateral aspect of the shoe and an upper portion extending in a direction toward a posterior aspect of the shoe, the upper portion comprising a first slidable sleeve;

a second lateral strap extending from the sole plate comprising a lower portion configured to wrap upward along a lateral aspect of the shoe and an upper portion extending in a direction toward the posterior aspect of the shoe, the upper portion comprising a second slidable sleeve;

a first tightening strap having a first end, an intermediate portion, and a second end, the first end of the first tightening strap connected to a posterior aspect of the toe cap;

a second tightening strap having a first end, an intermediate portion, and a second end, the first end of the second tightening strap connected to a posterior aspect of the toe cap;

wherein the intermediate portion of the first tightening strap is slideably coupled to the first sleeve and the intermediate portion of the second tightening strap is slideably coupled to the second sleeve; and a tightening mechanism interconnecting the second end of the first tightening strap and the second end of the second tightening strap.

2. The snowshoe binding of claim 1 wherein the toe cap is adapted to retract toward the sole plate and the first and second lateral straps are adapted to retract upward toward a lateral aspect of a shoe inserted in the binding when the first and second tightening straps are tightened.

3. The snowshoe binding of claim 2 wherein the binding is adapted to simultaneously urge the shoe towards the toe cap when the first and second tightening straps are tightened.

4. The snowshoe binding of claim 1 wherein the tightening mechanism comprises a buckle interconnected to the second end of the first tightening strap or second tightening strap and the second end of the other tightening strap comprises adjustment holes adapted to interconnect with the buckle.

5. The snowshoe binding of claim 1 wherein the tightening mechanism comprises one of a ratchet buckle, a rack and pinion mechanism, an adjustable side-release buckle, a strap lock buckle, or a cam buckle.

6. The snowshoe binding of claim 1 wherein the first slidable sleeve comprises a plurality of sleeves and the second slidable sleeve comprises a plurality of sleeves.

7. The snowshoe binding of claim 1 wherein shortening of at least one of the first and second tightening straps retracts a first and a second lateral side of the posterior aspect of the toe cap simultaneously and about equally in a downward direction toward the sole plate.

8. The snowshoe binding of claim 1 wherein lengthening of at least one of the first and second tightening straps allows extension of the first and second lateral straps away from a shoe inserted within the binding.

9. The snowshoe binding of claim 1 wherein lengthening of at least one of the first and second tightening straps allows extension of the toe cap away from the sole plate.

10. The snowshoe binding of claim 1 wherein the toe cap is interconnected to the sole plate by at least one anterior strap.

11. The snowshoe binding of claim 1 wherein the toe cap is interconnected to the sole plate by a plurality of anterior straps.

12. The snowshoe binding of claim 1 wherein the first lateral strap comprises a first vertical portion and a second vertical portion, and the second lateral strap comprises a first vertical portion and a second vertical portion.

13. The snowshoe binding of claim 1 wherein the sole plate, toe cap, lateral straps, and tightening straps are comprised of polyurethane.

14. The snowshoe binding of claim 1 further comprising a pad interconnected to a bottom surface of the toe cap.

15. The snowshoe binding of claim 1 wherein the sole plate and toe cap are formed from a single flexible material.

16. The snowshoe binding of claim 1 further comprising a crampon plate interconnected to the sole plate.

17. The snowshoe binding of claim 16 wherein the crampon plate comprises an axial channel adapted to rotatably interconnect with an axle.

18. The snowshoe binding of claim 1 wherein a lower portion of the first lateral strap extends outward from the sole plate and a lower portion of the second lateral strap extends outward from the sole plate.

* * * * *